US005695317A

United States Patent [19]

Ritter

[11] Patent Number: 5,695,317

[45] Date of Patent: Dec. 9, 1997

[54] STEAM TURBINE

[75] Inventor: Urs Ritter, Stüsslingen, Switzerland

[73] Assignee: Asea Brown Boveri AG, Baden, Switzerland

[21] Appl. No.: 746,938

[22] Filed: Nov. 18, 1996

[30] Foreign Application Priority Data

Dec. 7, 1995 [DE] Germany ..... 195 45 669.6

[51] Int. Cl.[6] ..... F01D 25/26

[52] U.S. Cl. ..... 415/108

[58] Field of Search ..... 415/108

[56] References Cited

FOREIGN PATENT DOCUMENTS 733628 3/1943 Germany .

*Primary Examiner*—John T. Kwon

*Attorney, Agent, or Firm*—Burns, Doane, Swecker & Mathis

[57] ABSTRACT

In a steam turbine, which essentially comprises a bladed rotor (2), an outer casing (4), at least one inner casing (3), a live-steam line (8) for inflowing steam (13), a valve (22) for setting the quantity of inflowing steam (13), and an exhaust-steam line (19) for the outflowing steam (17), the valve (22) is arranged in a connection piece (4a) of the outer casing (4). The part of the valve housing (10) to which the inflowing steam (13) is admitted is surrounded with steam, which fills the space (18) between inner casing (3) and outer casing (4).

3 Claims, 1 Drawing Sheet

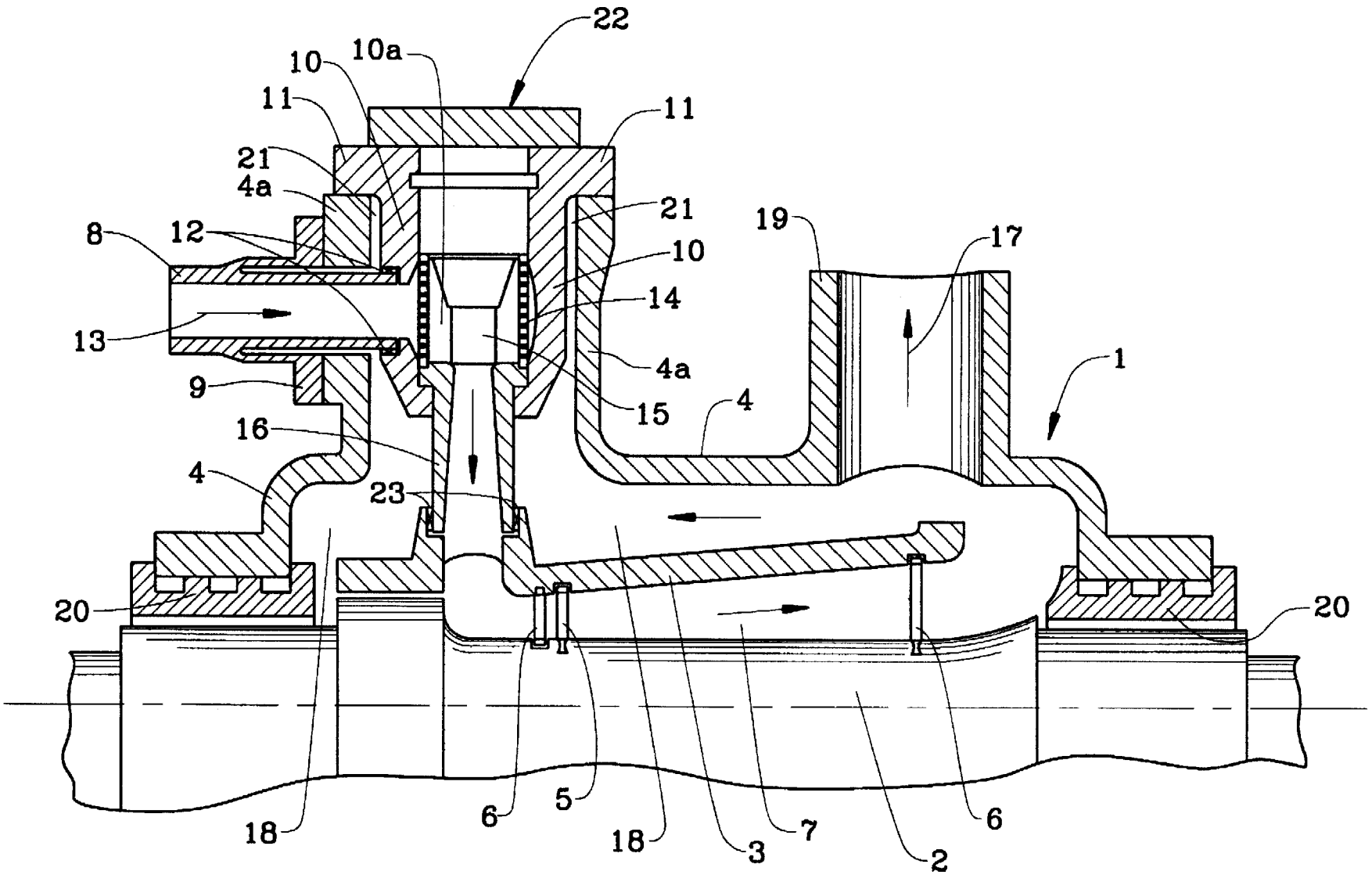
1
2
3
4
4
4a
4a
5
6
6
7
8
9
10
10
10a
11
11
12
13
14
15
16
17
18
18
19
20
20
21
21
22
23

STEAM TURBINE

BACKGROUND OF THE INVENTION

1. Field of the Invention

The invention relates to a steam turbine, essentially comprising a bladed rotor, an outer casing, at least one inner casing, a live-steam line for inflowing steam, a valve for setting the quantity of inflowing steam, and an exhaust-steam line for the outflowing steam, the valve being arranged in a connection piece of the outer casing.

2. Discussion of Background

Such steam turbines are known. The live-steam line leads into the valve for regulating the inflowing steam, which valve is arranged outside the outer casing of the steam turbine. The steam is then normally directed via a valve diffuser through the outer casing into the inner casing. The valve housing is therefore exposed to the ambient pressure and the ambient temperature. Since the inflowing steam can have, for example, temperatures of 600° C. and pressures of 300 bar, the valve and the valve housing are exposed to considerable loads.

SUMMARY OF THE INVENTION

Accordingly, one object of the invention in a steam turbine of the type mentioned at the beginning is to provide novel valves for increased loads having wall thicknesses and dimensions which are still manageable.

According to the invention, this is achieved in that the part of the valve casing to which the inflowing steam is admitted is surrounded with steam, which fills the space between inner casing and outer casing.

The advantages of the invention may be seen, inter alia, in the fact that the temperature and pressure differences to be absorbed by the valve housing are considerably reduced. This is also the case when using inflowing steam having extreme steam data. Steam having very high steam data can thereby be reliably controlled by this arrangement. Furthermore, the valve housing can be designed to be of a small size due to the lower load. This reduces the costs of the valve. In addition, the thermal stresses are reduced due to the relatively small temperature differences from inside to outside which occur in operation, a factor which permits a quicker change in the operating state as well as in the steam data (temperature and pressure).

BRIEF DESCRIPTION OF THE DRAWING

A more complete appreciation of the invention and many of the attendant advantages thereof will be readily obtainable as the same becomes better understood by reference to the following detailed description when considered in connection with the accompanying drawing, wherein an exemplary embodiment of the invention is shown with reference to a schematic partial longitudinal section through a high-pressure steam turbine.

DESCRIPTION OF THE PREFERRED EMBODIMENT

Referring now to the drawing, wherein only the elements essential for understanding the invention are shown, a steam turbine 1 essentially comprises a bladed rotor 2, and inner casing 3 and an outer casing 4. The rotor 2 is fitted with moving blades 5 which are arranged in a plurality of rows (not shown). The rotor 2 is enclosed by the inner casing 3, which serves as guide-blade carrier for guide blades 6. The guide blades 6 are likewise arranged in a plurality of rows in such a way as to alternate with the moving-blade rows. An essentially annular duct 7 is formed by the outer boundary of the rotor 2 and the inner wall of the inner casing 3. The rotor 2 and the inner casing 3 are enclosed by the outer casing 4, shaft seals 20 being arranged at the transition from the outer casing to the rotor.

The inflowing steam 13 is directed via a live-steam line 8 through a connection piece **4*a* of the outer casing 4 into the valve housing 10 of a valve 22, which is arranged essentially in the interior of the outer-casing connection piece 4*a*. The live-steam line 8 is connected to the connection piece 4*a* and thus to the outer casing 4 via flanges 9, and the valve housing 10 is connected by flanges 11 to the outer-casing connection piece 4*a*. The live-steam line 8 and the interior space 10*a* of the valve housing 10 are sealed off from the interior space 18 of the outer casing 4 and the connection piece 4*a* via sealing elements 12, for example piston rings, arranged at the downstream end of the live-steam line 8. The inflowing steam is then directed via a cylindrical steam filter 14 to the interior space 10*a* of the valve housing 10. The rate of flow of the inflowing steam can be set by means of a valve body 15. The drive of the valve body 15 as well as the further elements necessary for actuating the valve body are not shown in any more detail. The steam then flows into the annular duct 7 via a valve diffuser 16 fixed to the valve housing. Arranged at the downstream end of the valve diffuser are sealing elements 23 which seal off the interior space of the valve diffuser and the annular duct 7 from the interior space 18. The temperature of the steam drops due to the delivery of energy to the rotor 2 via the moving blades 5 of the blade rows. This steam 17 is directed into the interior space 18 between inner and outer casing and is then discharged via an exhaust-steam line 18**.

The valve housing 10 is configured in such a way that it is surrounded at least partly by outflowing steam, i.e. the steam which fills the space 18 between inner casing 3 and outer casing 4. In the drawing, an annular recess 21 is arranged for this purpose between the outer-casing connection piece **4*a* and the valve housing. Consequently, the outside of the valve housing 10 is essentially at the temperature and the pressure of the outflowing steam 17**. The temperature and pressure difference from the outside of the valve housing to the inside of the valve housing, i.e. of the inflowing steam, consequently drops compared with a valve housing which is arranged outside the outer casing.

Numerical Example for a High-pressure Steam Turbine inflowing steam: 250–300 bar/540°–600° C.

outflowing steam: 50–100 bar/300°–450° C.

The maximum temperature difference between the outside and the inside of the valve housing is therefore about 150° C., and the maximum pressure difference is about 200 bar. The loads on the valve 22 caused by the inflowing steam are therefore decisively reduced.

The invention is of course not restricted to the exemplary embodiment shown and described. A plurality of valves may also be used to regulate the inflowing steam. The valve may also be arranged outside the outer casing, in which case the valve is then of double-wall configuration and outflowing steam is fed into the intermediate space thus formed. If, for example, further casings are arranged between inner and outer casing, the valve can be of multi-wall configuration in accordance with the number of casings, the steam from the formed interior spaces of the casings being directed into the formed intermediate spaces.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A steam turbine, essentially comprising a bladed rotor (2), an outer casing (4), at least one inner casing (3), a live-steam line (8) for inflowing steam (13), a valve (22) for setting the quantity of inflowing steam (13), and an exhaust-steam line (19) for the outflowing steam (17), the valve (22) being arranged in a connection piece (4*a*) of the outer casing (4), wherein the part of the valve casing (10) to which the inflowing steam (13) is admitted is surrounded with steam, which fills the space (18) between inner casing (3) and outer casing (4).

2. The steam turbine as claimed in claim 1, wherein an annular recess (21) is arranged between the valve housing (10) and the connection piece (4*a*).

3. The steam turbine as claimed in claim 2, wherein the live-steam line (8) to the valve (22) is connected to the connection piece (4*a*), and wherein the live-steam line (8) leads into the valve housing (10).

* * * * *